United States Patent [19]

Tajima

[11] Patent Number: 4,976,128

[45] Date of Patent: Dec. 11, 1990

[54] ROLLING MILL AND METHOD OF EXCHANGING ROLLS OF ROLLING MILL

[75] Inventor: Sadayoshi Tajima, Hitachi, Japan

[73] Assignee: Hitachi, Ltd., Tokyo, Japan

[21] Appl. No.: 375,905

[22] Filed: Jul. 6, 1989

[51] Int. Cl.[5] ..... B21B 31/08

[52] U.S. Cl. ..... 72/238; 72/241.2; 72/244; 72/248

[58] Field of Search ..... 72/238, 241, 243, 244, 72/248, 245

[56] References Cited

U.S. PATENT DOCUMENTS

| | | | |
|---|---|---|---|
| 2,260,762 | 10/1941 | Yarrington et al. | 72/238 |
| 2,853,905 | 9/1958 | Reisacher et al. | 72/238 |
| 3,164,044 | 1/1965 | Trapp | 72/243 |
| 3,333,453 | 8/1967 | Guillot | 72/245 |
| 3,435,649 | 4/1969 | O'Brien | 72/248 |
| 4,038,857 | 8/1977 | Eibe et al. | 72/244 |

FOREIGN PATENT DOCUMENTS

| | | | |
|---|---|---|---|
| 2326428 | 12/1974 | Fed. Rep. of Germany | 72/244 |
| 58-163510 | 9/1983 | Japan . | |
| 60-146512 | 9/1985 | Japan . | |

*Primary Examiner*—Lowell A. Larson

*Assistant Examiner*—T. C. Schoeffler

*Attorney, Agent, or Firm*—Fay, Sharpe, Beall, Fagan, Minnich & McKee

[57] ABSTRACT

A rolling mill has upper and lower work rolls brought into contact with a material to be rolled. An upper backup roll supports the upper work roll, and a hydraulic jack above the upper backup roll adds a pressurizing load adjusted in accordance with a rolling load to the upper work roll via the upper backup roll. The hydraulic jack includes a cylinder arranged such that its bore faces downward and contains therein a slidable ram. A thrust metal block is disposed on an upper surface of the cylinder in a manner which allows it to move between a first position for the rolling work and a second position for exchanging the rolls, the second portion being spaced apart from the first position in an axial direction of the upper backup roll. A pressurizing screw is arranged to abut on an upper surface of the thrust metal when the thrust metal is at the first position, so as to restrict an upward movement of the thrust metal and thereby determine a position of the upper work roll. Further, an actuator is mounted on the cylinder and operatively connected to the thrust metal for moving the thrust metal between the first position and the second position.

12 Claims, 9 Drawing Sheets

ROLLING MILL AND METHOD OF EXCHANGING ROLLS OF ROLLING MILL

BACKGROUND OF THE INVENTION

1. Field of the Invention

The present invention relates to a rolling mill of a type comprising: an upper work roll and a lower work roll brought into contact with a material to be rolled; an upper backup roll for supporting the upper work roll, a hydraulic jack disposed above the upper backup roll and capable of adding a pressure adjusted in correspondence with the rolling load to the upper work roll via the upper backup roll, a thrust metal block arranged above the hydraulic jack; and a pressurizing screw brought into contact with the upper surface of the thrust metal means to limit the upward movement of it or positioning the upper work roll.

2. Description of the Prior Art

A rolling mill of the type described above is, for example, disclosed in Japanese Patent Unexamined Publication No. 58-163510, in which a space needed for roll exchange is secured by moving, along the carrier rail, the hydraulic jack together with the thrust metal block in the axial direction of the rolls. The hydraulic jack included in this rolling mill comprises a cylinder having an upward cylinder bore formed therein and a ram disposed on the upside of this cylinder and capable of being moved within this cylinder bore. The thrust metal block is disposed above the ram, and a control unit is provided for the cylinder body for the purpose of adjusting the quantity of the hydraulic oil in the space between the cylinder and the ram in accordance with the rolling load.

However, the conventional rolling mill encounters a problem in that a long carrier rail and a large-size and long-stroke cylinder for retracting the hydraulic jack needs to be provided.

Furthermore, the rolling mill is arranged in such a manner that the cylinder of the hydraulic jack is disposed below the ram and is positioned in contact with the upper portion of the upper backup roll chock. Therefore, an impact generated due to the fact that the material to be rolled is caught by the rolling mill or is moved out of the rolls can be directly transmitted to the cylinder of the hydraulic jack via the upper backup roll, causing the control unit provided for this cylinder to be damaged to the life of it to be shortened.

SUMMARY OF THE INVENTION

An object of the present invention is to provide a rolling mill and a method of exchanging rolls of the rolling mill.

According to an aspect of the present invention, there is provided a rolling mill comprising: upper and lower work rolls arranged to be brought into contact with a material to be rolled; an upper backup roll for supporting the upper work roll; a hydraulic jack disposed above the upper backup roll for adding a pressurizing load which has been adjusted according to a rolling load to the upper work roll via the upper backup roll, the hydraulic jack including a cylinder so disposed that a cylinder bore thereof faces downward and having an upper surface, and a ram slidably received in the cylinder bore and having a lower surface which is brought into contact with the upper backup roll; a thrust metal block disposed on the upper surface of the cylinder and capable of being moved between a first position at which rolling work is performed and a second position at which the rolls are exchanged, the second position being spaced apart from the first position in an axial direction of the upper backup roll; a pressurizing screw adapted to abut on the upper surface of the thrust metal for restricting an upward movement of the thrust metal to thereby determine a position of the upper work roll when the thrust metal is at the first position; and an actuator mounted on the cylinder and operatively connected to the thrust metal for moving the thrust metal between the first position and the second position.

According to another aspect of the present invention, there is provided a rolling mill comprising: upper and lower work rolls arranged to be brought into contact with a material to be rolled; an upper backup roll for supporting the upper work roll; a hydraulic jack disposed above the upper backup roll for adding a pressurizing load which has been adjusted according to a rolling load to the upper work roll via the upper backup roll, the hydraulic jack containing a cylinder so disposed that its cylinder bore faces downward and has a ram slidably disposed therein, and has an upper surface; A thrust metal blocks disposed on the upper surface of the cylinder; a pressurizing screw is adapted to abut on an upper surface of the thrust metal for restricting an upward movement of the thrust metal means to thereby determine a position of the upper work roll. A control unit is mounted on the cylinder for controlling a quantity of pressurized oil in a space defined between the cylinder and the ram in accordance with a rolling load.

According to a further aspect of the present invention, there is provided a method of exchanging rolls of a rolling mill including an upper backup roll for supporting an upper work roll; a hydraulic jack disposed above the upper backup roll for adding a pressurizing load which has been adjusted in accordance with a rolling load to the upper work roll via the upper backup roll. A thrust metal block is disposed on the hydraulic jack, and a pressurizing screw is adapted to abut on the thrust metal for restricting an upward movement of the thrust metal to thereby determine a position of the upper work roll: The method comprises the steps of moving the thrust metal means in an axial direction of the upper backup roll to a position at which the thrust metal does not meet the pressurizing screw without moving the hydraulic jack; and raising the upper backup roll together with the hydraulic jack to separate the upper backup roll from the upper work roll.

The rolling mill according to the present invention has a wide area on the upper surface of the cylinder, which provides a sufficient space for moving the thrust metal between a first position at which the rolling work is performed and a second position at which the rolls are exchanged. Therefore, the roll exchange can be quickly performed without any necessity of moving the hydraulic jack.

In addition, an excessive impact generated at the time of catch of the material to be rolled by the rolling mill or escape or draw-out of the material to be rolled from the rolls is transmitted from the upper backup roll chocks to the ram of the hydraulic jack, and is then transmitted from this ram, via pressurized oil in the hydraulic jack, to the cylinder of the hydraulic jack. Therefore, the impulsive load to be transmitted to the cylinder can be halved or reduced to a quarter by the elastic energy of the pressurized oil. Therefore, when a control unit such as a servo valve or the like is mounted on the cylinder body, the control unit can be protected from damage due to the impulsive load.

In addition, since the hydraulic jack does not need to be moved as needed in the conventional art, the long carrier rail or the like for moving it is no longer necessary. Therefore, the cost of the mill can be reduced and the working efficiency can be improved.

Further objects, characteristics, and advantages will be apparent from the following description with reference to the accompanying drawings.

DESCRIPTION OF THE PREFERRED EMBODIMENTS

Figure 1:
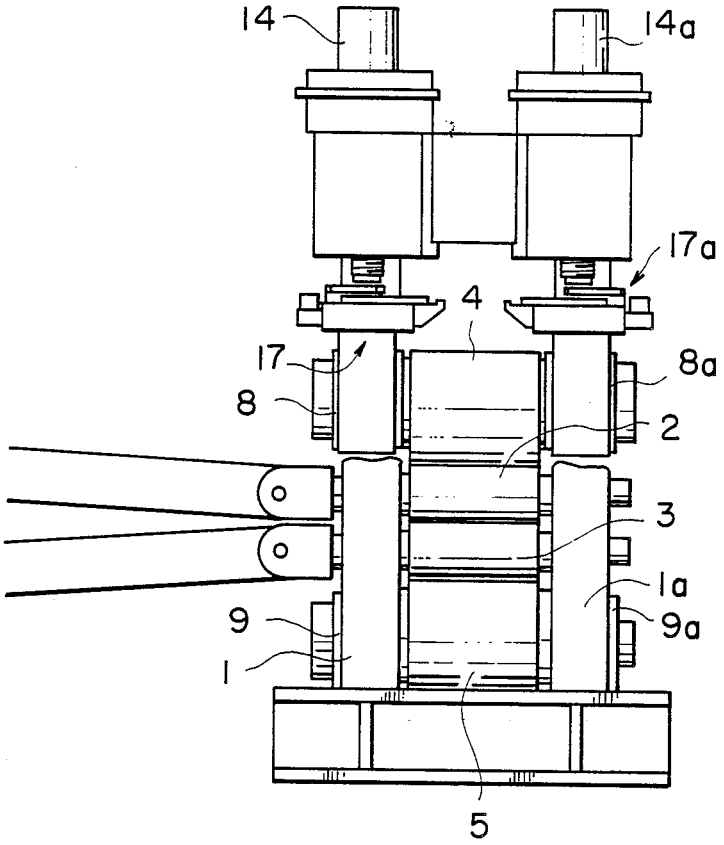
FIG. 1 is a schematic side elevational view which illustrates a rolling mill according to a first embodiment of the present invention.

First, a conventional rolling mill of the above-described type disclosed in Japanese Patent Unexamined Publication No. 58-163510 will be described with reference to FIG. 10.

The rolling mill comprises an upper work roll 102, a lower work roll 103, an upper backup roll 104, and a lower backup roll 105. Hydraulic jacks 117 and 117*a* are disposed above the upper backup roll 104. Each of the hydraulic jacks 117 and 117*a* comprises a cylinder whose cylinder bore faces upward and a ram disposed on the upside of the cylinder and capable of moving within the cylinder bore. Thrust metals 123 and 123*a* are disposed above the ram of the hydraulic jacks 117 and 117*a*. Furthermore, pressurizing screws 114 and 114*a* are capable of being brought into contact with the upper surfaces of the thrust metals 123 and 123*a* and thereby capable of limiting the upward movement of these thrust metals 123 and 123*a* for the purpose of positioning the upper work roll 102.

The rolling mill is so structure that a space which is necessary for performing roll exchange work is secured by moving the hydraulic jacks 117 and 117*a* together with the thrust metals 123 and 123*a* along a carrier rail 150 in the axial direction of the rolls. That is, wheels 151 and 151*a* are provided for the hydraulic jacks 117 and 117*a* so that these hydraulic jacks 117 and 117*a* are arranged to be able to move in the axial direction of the rolls with the wheels 151 and 151*a* rolled along the carrier rail 150 supported by a rail support body 100. Referring to FIG. 10, reference numeral 152 represents a retractable cylinder for moving the hydraulic jacks 117 and 117*a*, 153 represents a spindle for rolling the work rolls 102 and 103, 101 and 101*a* represent housings, one of which is disposed on the roll drive side, while another one is disposed on the roll exchange side.

However, the above-described rolling mill encounters the following problems:

(a) A lengthened carrier rail 150 and a rail support body 100 are necessary in order to move the hydraulic jacks 117 and 117*a* in the axial direction of the rolls;

(b) The structure is arranged such that the rail support body 100, carrier rail 150, and the retractable cylinder 152 outwardly overhang to a considerable extent and the spindle 153 is disposed below the thus-overhung components. Therefore, a crane cannot be used at the time of performing the maintenance or inspection work. In addition, there is a fear of falling of the thus-overhung components;

(c) Since the hydraulic jacks 117 and 117*a*, are arranged to move, a special structure is needed to protect the hydraulic pressure pipes and hoses from damage. In addition, a considerably wide space is necessary for the purpose of realizing the movement of the hydraulic pressure pipes and hoses.

(d) Since the cylinder of each of the hydraulic jacks 117 and 117*a* is disposed below the ram and in contact with the upper surface of the upper backup roll 104, an impact generated when the material to be rolled is caught by the rolling mill or is moved out of the rolls is directly transmitted to the cylinder of the hydraulic jacks 117 and 117*a* via the upper backup roll 104. Since a control unit such as a servo-valve or the like is mounted on this cylinder, the control unit cannot be protected from a damage and its life expectancy becomes too short.

FIGS. 1 to 6 are views which illustrate a first embodiment of a rolling mill according to the present invention. This rolling mill comprises housings 1 and 1*a* one of which is arranged for a roll drive side and another one is arranged for a roll exchange side or exchange operation side. Housings 1 and 1*a*, hold an upper work roll 2, lower work roll 3, and upper and lower backup rolls 4 and 5 which support the upper work roll 2 and the lower work roll 3 in an abutment manner. The two ends of the upper work roll 2 are so supported by upper work roll chocks (the upper work roll chock on the roll drive side being indicated by 6 in FIG. 2) as to be able to rotate. The two ends of the lower work roll 3 are so supported by lower work roll chocks (the lower work roll chock on the roll drive side indicated by 7 in FIG. 2) as to be able to rotate. The two ends of the upper backup roll 4 are so supported by upper backup roll chocks 8 and 8*a* as to be able to rotate. The two ends of the lower backup roll 5 are so supported by lower backup roll chocks 9 and 9*a* as to be able to rotate. In order to give the work rolls 2 and 3 a proper roll bending, the upper and lower work roll chocks are respectively supported by balance cylinders (the balance cylinders supporting the upper and lower work roll chocks on the roll drive side being indicated by 10 and 11 in FIG. 2) in such a manner that the upper and lower work roll chocks are able to be moved vertically. Connected to the upper backup roll chocks are another set of balance cylinders (the balance cylinders connected to the chock 8 being indicated by 12 in FIG. 2), and the upper backup roll 4 is supported by the latter balance cylinders in a balanced manner via the upper backup roll chocks 8 and 8*a*.

Hydraulic jacks 17 and 17*a* include cylinders 15 and 15*a* and rams 16 and 16*a* between the upper portion of the upper backup roll chocks 8 and 8*a* and pressurizing screws 14 and 14*a*. As is clearly seen from FIG. 3, thrust metal blocks 18 and 18*a* and control units 19 and 19*a* to be described later are respectively provided above the hydraulic jacks 17 and 17*a* and side portions of the same.

Figure 3:
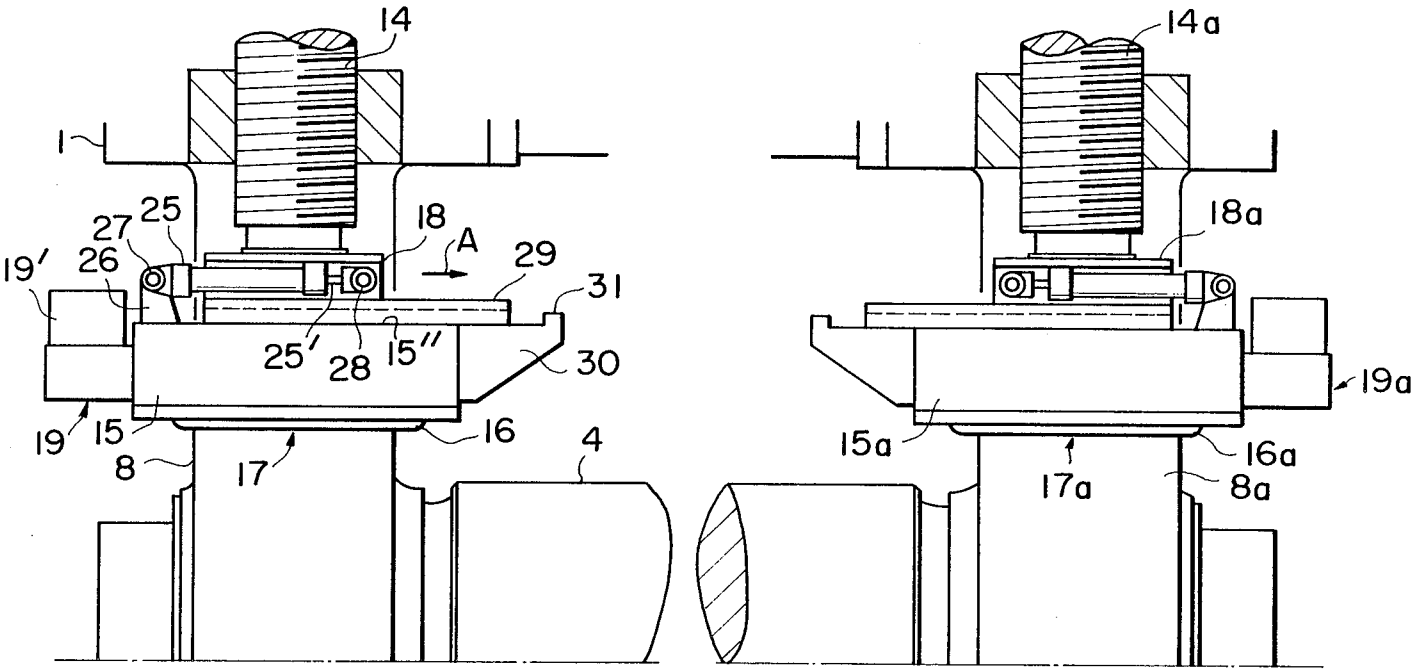
FIG. 3 is an enlarged view which illustrates the arrangement of a pressurizing screw, hydraulic jack, slide metal block and so forth included in the rolling mill in a state where the slide metal block is positioned when rolling work is performed.

As can be clearly seen from FIGS. 1 and 3, the chock 8, the pressurizing screw 14, the hydraulic jack 17, the thrust metal block 18, the control unit 19, and the associated components on the drive side are disposed symmetrically to those on the roll exchange side and operate in a similar manner. Also the chocks 6, 7, and 9 and the balance cylinders 10, 11 and 12 on the drive side are similarly provided to those on the roll exchange side. Therefore, the description will be in concerning the components on the drive side, and the roll exchange side is omitted from detailed descriptions. The components on the roll exchange side which are similar to those on the roll drive side are given the same numerals with character a for the purpose of identification.

The hydraulic jack 17 comprises a cylinder 15 whose cylinder bore 15' is arranged to face downward and a ram 16 disposed on the downside of the cylinder 15 and capable of moving within the cylinder bore 15'. High pressure oil 20 is enclosed between the cylinder 15 and the ram 16 for the purpose of generating a pressurizing load which corresponds to the rolling load. The control unit 19, including a control valve 19' such as a servovalve, is directly mounted on the cylinder 15. The control unit 19 controls the quantity of high pressure oil 20 so that a rolling load which is controlled in correspondence with the rolling load is generated. Thus, the shape of the rolled product can be controlled. The above-described structure is arranged such that the control unit 19 directly mounted on the cylinder 15 is capable of improving the control response since the length of the hydraulic pressure pipes can be shortened. Therefore, such a structure can be preferably employed for a high speed rolling mill (a plate mill or the like).

Figure 2:
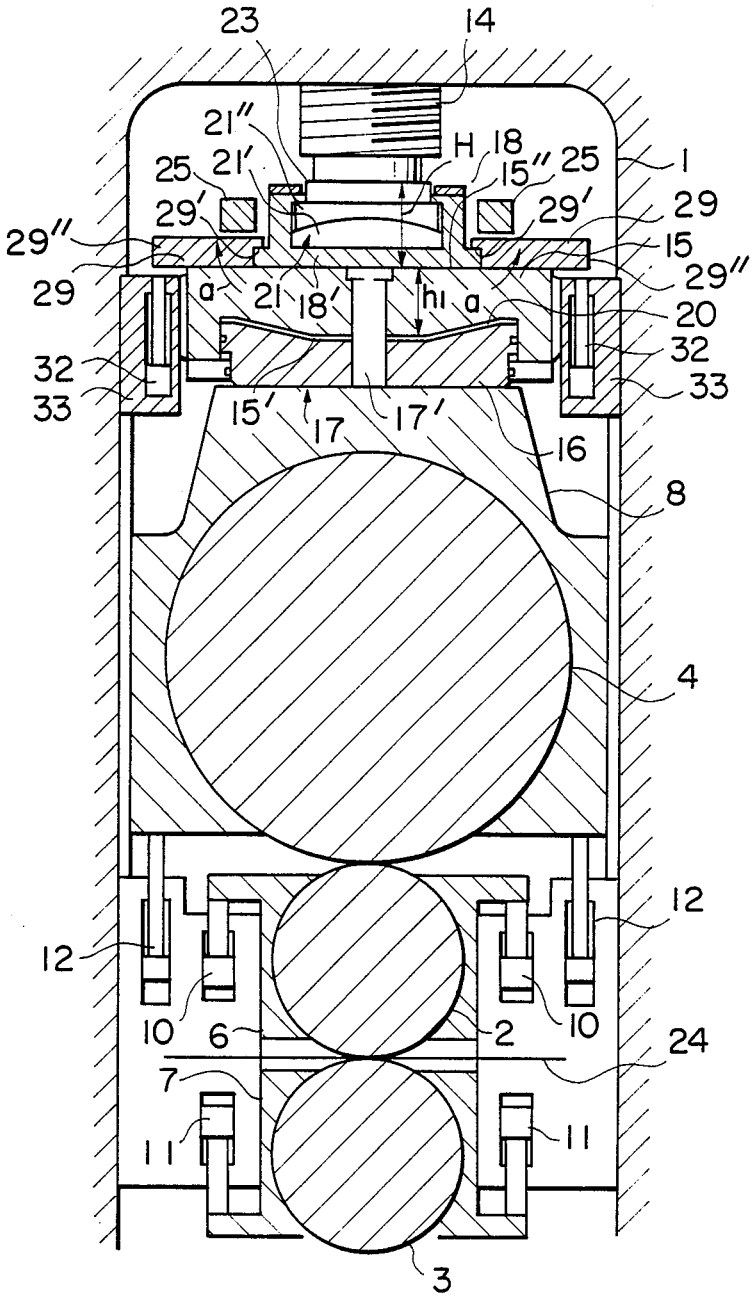
FIG. 2 is a front elevational cross-sectional view which illustrates the rolling mill according to the present invention when viewed from the roll drive side.

Referring to FIG. 2, reference numeral 17' represents a part for detecting the level of high pressure oil 20. The thrust metal block 18 is disposed on the upper surface 15'' of the cylinder 15 of the hydraulic jack 17. The housing 18' of this thrust metal block 18 accommodates a seat 21, comprising a lower member 21' having a spherical upper surface, and an upper member 21'' which is brought into sliding contact with the spherical upper surface. A thrust metal 23 which is so disposed as to be able to move on the upper surface of the upper member 21'' of the seat 21. The lower end of the pressurizing screw 14 is brought into contact with the thrust metal 23 so that the upward movement of the thrust metal is restricted. Therefore, by adjusting the pressurizing screw 14, the upper work roll 2 can be positioned to a predetermined position allowing the gap between the upper work roll 2 and the lower work roll 3 to be adjusted. The pitch of the pressurizing screw 14 cannot be too large because the inverse rotation of the same, due to a large load added by the rolling work, needs to be prevented. Therefore, it is practical for the lowering speed of this screw 14 to be around 1 to 2 mm/s.

Figure 5:
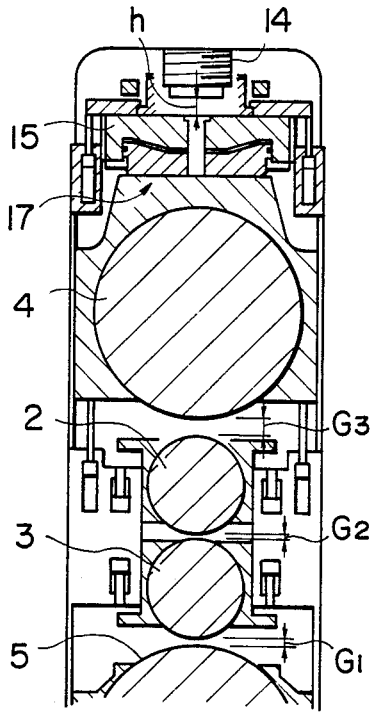
FIG. 5 is a view which illustrates a state where the preparation for work roll change has been completed when viewed similarly to FIG. 2.
Figure 6:
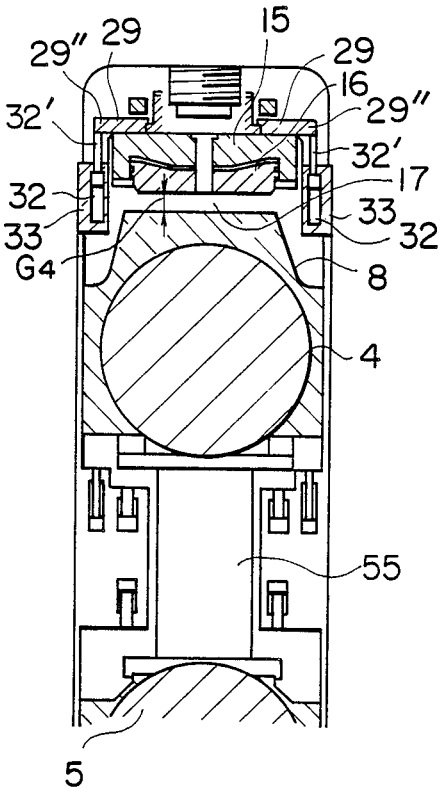
FIG. 6 is a view which illustrates a state where the preparation for the backup roll exchange has been completed when viewed similarly to FIG. 2.

FIG. 2 is a view which illustrates a state where a plate material 24 is rolled, in which the upper and lower work rolls 2 and 3, and the upper and lower backup rolls 4 and 5 are brought into contact with each other to maintain the large load which is required. On the other hand, when the rolls are exchanged, gaps $G_2$, $G_3$, and $G_1$ are, as shown in FIG. 5, respectively necessary between the upper and lower work rolls 2 and 3, between the upper work roll 2 and the upper backup roll 4, and between the lower work roll 3 and the lower backup roll 5 for the purpose of drawing out the work rolls 2 and 3. In order to attain these gaps, it might be considered to employ a method of turning and raising the pressurizing screw 14. However, since the screw turning speed is limited to a low speed and the distance needed to move the pressurizing screw 14 is too large (usually it needs 100 to 150 mm), it takes about one to three minutes to form the gaps. Therefore, the manufacturing yield deteriorates excessively.

Figure 10:
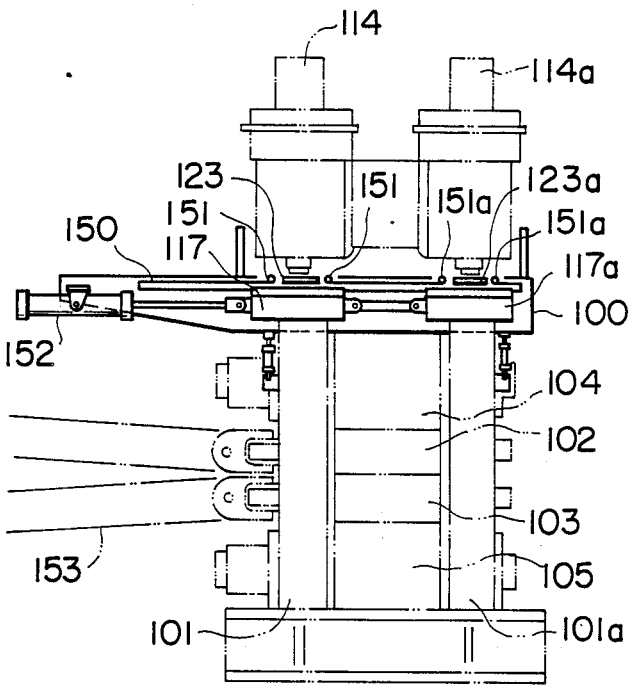
FIG. 10 is a schematic side elevational view which illustrates a conventional rolling mill.

In order to overcome this problem, the conventional rolling mill shown in FIG. 10 employs a method which slides the hydraulic jacks 117 and 117*a* in the axial direction of the rolls to facilitate their replacement. However, a problem arises because a considerably large sized mechanism is necessary for retracting the hydraulic jacks.

Figure 4:
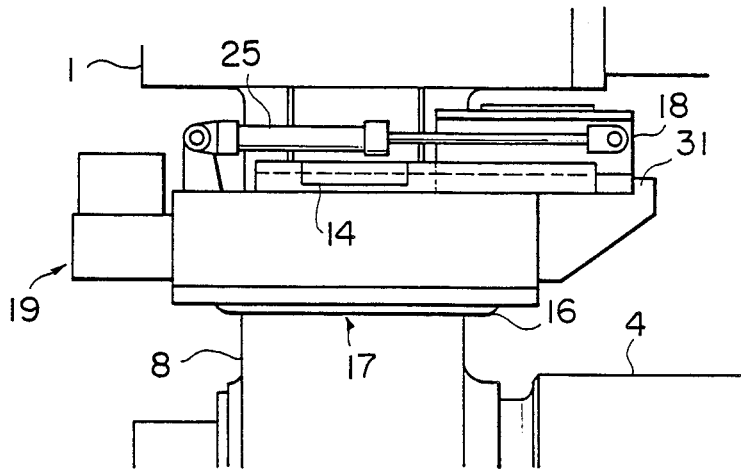
FIG. 4 is a view which illustrates the components on the roll drive side shown in FIG. 3 in a state where the slide metal block is positioned when the rolls are exchanged and the hydraulic cylinder and the upper backup roll are lifted.

According to this embodiment of the rolling mill, the cylinder 15 and the ram 16 of the hydraulic jack 17 are, as shown in FIG. 2, disposed inversely with respect to the conventional disposition. Namely, the cylinder 15 is disposed on the upside, while the ram 16 is disposed on the downside. Furthermore, the thrust metal block 18 is disposed between the position shown in FIG. 3 at which the roll work is performed and the position shown in FIG. 4 at which the rolls are exchanged in such a manner that this thrust metal block 18 slides the flat upper surface 15'' in the axial direction of the rolls. A bracket 26 is secured to the upper surface of the cylinder 15, this bracket 26 supporting, with a support pin 27, a cylinder 25 (or an actuator such as a motor cylinder). The front end portion of the rod 25' of the cylinder 25 is connected, with a support pin 28, to the side surface of the block 18. As will be understood from FIGS. 2 and 3, a cylinder 25 is provided on each side of the block 18. Therefore, also the bracket 26, and support pins 27 and 28 are provided on each side of the block 18. Guide blocks 29, each having a guide surface 29' which can be brought into contact with a lateral projection from the bottom portion of the block 18, are secured respectively on those parts of the upper surface of the cylinder 15 adjacent to both sides of the block 18. In addition, a block 30, having a stopper 31, is secured at an end portion which opposes the control unit 19 of the cylinder 15. Therefore, when the cylinder 25 is operated at the position shown in FIGS. 3 at which the roll work is performed and the rod 25' thereof is drawn out, the block 18 is, together with the rod 25', moved in the direction designated by an arrow A along the guide surface 29' of the guide block 29 until it is brought into contact with the stopper 31. Block 18 does not align the pressurizing screw 14 in the vertical direction when the same is positioned in contact with the stopper 31. That is, the block 18 does not meet the pressurizing screw 14 due to its sideways displacement. In this state, by operating the cylinders 12, the backup roll 4 can be quickly raised together with the hydraulic jack 17 via the upper backup roll chock 8. The state in which the upper backup roll 4 is thus raised is shown in FIG. 4.

A necessary distance ΣG for the upper backup roll 4 to be lifted can be expressed by the following formula:

$$\Sigma G = G_1 + G_2 + G_3$$

On the other hand, it is necessary for the overall height "H" of the thrust metal block 18 to be $H \geqq \Sigma G + h$, where $h \geqq 0$ in order to obtain the ΣG, where the "h" represents, as shown in FIG. 5, the gap between the lower end portion of the pressurizing screw 14 and the upper end of the cylinder 15 of the hydraulic jack 17.

Now, an exchange of the backup rolls after the upper and lower work rolls have been drawn out with the upper backup roll 4 raised as described above will be described. When the backup rolls are exchanged, a jig for exchanging the upper and the lower backup rolls 4 and 5 is inserted between these two backup rolls 4 and 5 so that the upper and the lower backup rolls 4 and 5 may be integrally drawn out from the housing 1. At this time, it is necessary for a gap $G_4$ to be formed between the upper backup roll chock 8 and the ram 16 of the hydraulic jack 17. In order to form this gap, blocks 33 including balance cylinders 32 for the hydraulic jack 17 are secured to the housing 1 according to this embodiment. The balance cylinders 32 are arranged such that when they draw out the rods 32', the upper ends of the rods 32' are brought into contact with the projections 29'' of the guide blocks 29 outwardly projecting over the cylinder 15 and thereby, these guide blocks 29 are raised. As result, the hydraulic jack 17 is raised with these guide blocks 29. As described above, by operating the cylinders 32, the necessary gap $G_4$ is formed so that the backup rolls 4 and 5 may be exchanged.

Another aspect of this embodiment will be described with reference to FIGS. 2 and 3. When the material to be rolled is caught by the rolls or the material is drawn out or escaped from the rolls, a considerably large impulsive load is generated. The impulsive load generated at the work rolls 2 and 3 are transmitted to the hydraulic jack 17 via the upper backup roll 4 and the upper backup roll chock 8. The magnitude of such an impulsive load can be expressed by the following formula which relates to a spring constant of the material through which the impulsive load is transmitted:

$$P = \sqrt{\frac{KWv^2}{g}}$$

where

P: impulsive load
K: spring constant
W: weight
v: impact speed
g: the acceleration of gravitation Assuming that $$\sqrt{\frac{Wv^2}{g}} = C,$$

it holds that $P = C\sqrt{K}$. Therefore, the impulsive load ratio of a load when the impulsive load is transmitted via high pressure oil 20 to the load when the same is transmitted without passing through the high pressure oil 20 can be expressed as follows:

$$\alpha = C\sqrt{\frac{K_1}{K_1 + K_2}}$$

where $K_1$: the bulk modulus of oil $= 1.43 \times 10^5$ kg/cm$^2$
$K_2$: the bulk modulus of steel $= 2.1 \times 10^6$ kg/cm$^2$ According to this embodiment, ram 16 of the hydraulic jack 17 is brought into contact with the upper backup roll chock 8, and the impulsive load which has been transmitted from the chock 8 to the ram 16 can be transmitted, via high pressure oil 20, to the cylinder 15 of the hydraulic jack 17. Furthermore, the control unit 19 including the control valve 19' is mounted on this cylinder 15. Therefore, the magnitude of the impulsive load transmitted to the cylinder 15 can be reduced, and thereby the impulsive load transmitted to the control unit 19 can also be reduced. For example, the impulsive load transmitted to the control unit 19 can be reduced to a quarter with respect to the magnitude displayed in the case where the cylinder is disposed below the ram of the hydraulic jack and the control unit is directly fastened to this cylinder. As a result, the control unit 19 can be protected from damage and its life can be significantly lengthened.

According to this embodiment, the thickness of the top portion of the cylinder 15 of the hydraulic jack 17 is relatively larger at the central portion thereof and relatively smaller at the periphery thereof. That is, as shown in FIG. 2, the top portion of the cylinder has a relatively large thickness $h_1$ at the central portion thereof, this thickness being gradually reduced in the direction toward the periphery of the same. The thus-arranged structure can effectively protect the cylinder 15 from any deformation such as a warp as designated by arrows a (see FIG. 2) when the rolling mill is operated as follows: the cylinder 15 is upwardly pushed by the upper surface of the ram 16 which has a predetermined large area, and this pushing force is, via the thrust metal block 18, borne by the lower surface of the pressurizing screw 14 which has a predetermined small area.

Figure 7:
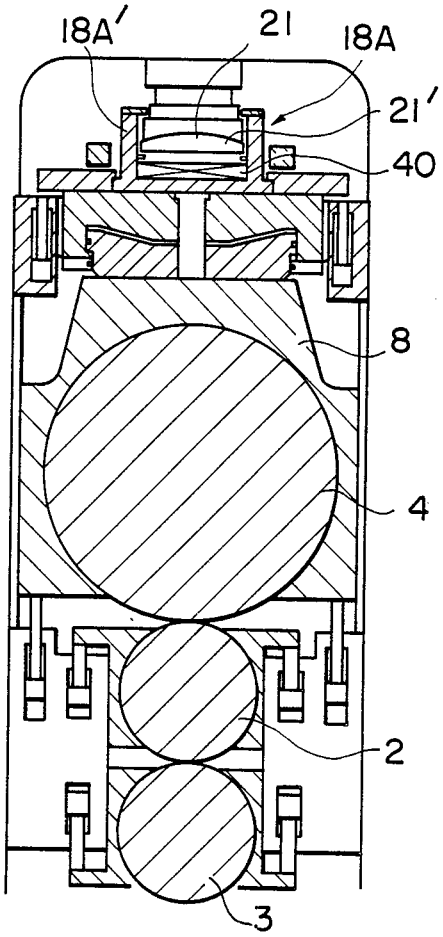
FIG. 7 is a view which illustrates the rolling mill according to a second embodiment of the present invention when viewed similarly to FIG. 2.

FIG. 7 is a view which illustrates a second embodiment of a rolling mill according to the present invention which has a load cell 40 for measuring the rolling load disposed below the lower member 21' of the seat 21 in a housing 18A' of a thrust metal block 18A. The other structures are the same as that of the first embodiment. The same or similar components shown in FIG. 7 as those shown in FIGS. 1 to 6 are given the same reference numerals.

Figure 8:
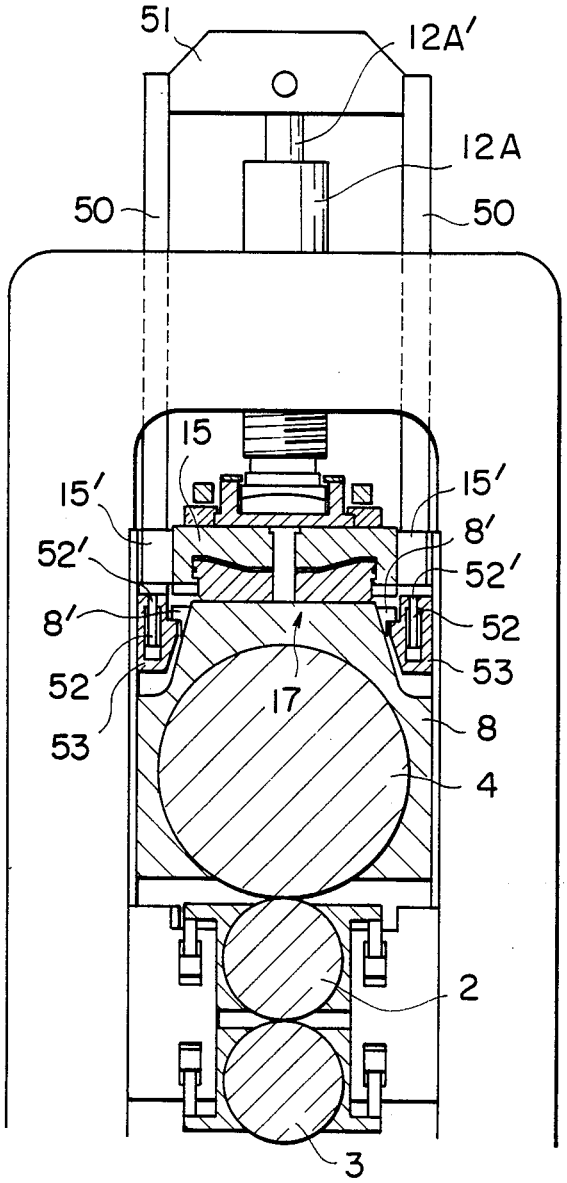
FIG. 8 is a view which illustrates the rolling mill according to a third embodiment of the present invention when viewed similarly to FIG. 2.
Figure 9:
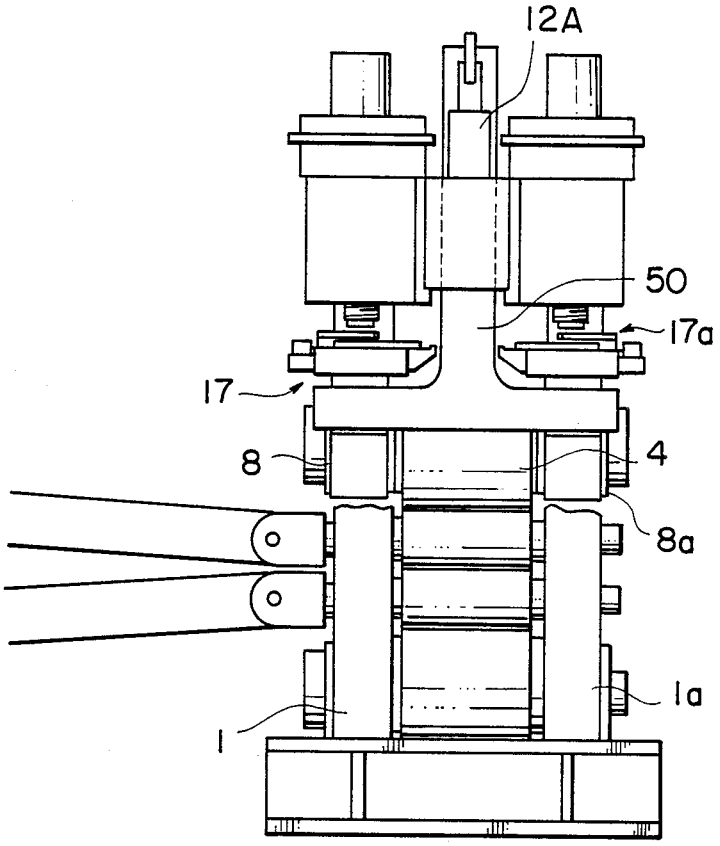
FIG. 9 is a schematic side elevation view of the rolling mill shown in FIG. 8.

FIGS. 8 and 9 are views which illustrate a third embodiment of the present invention. According to this embodiment, a balance cylinder 12A for the upper backup roll 4 is disposed at an upper position of the mill. The upper ends of carrier beams 50 are connected, through a connecting member 51, to a rod 12A' of the balance cylinder 12A. The lower ends of the carrier beams 50 engage with projections 8' projecting laterally from an upper backup roll chock 8 in a manner to suspend the chock 8 and hence the roll 4 from the carrier beams 50. It is to be noted that the lower ends of the carrier beams 50 also engage with similar projections (not shown) projecting laterally from an upper backup roll chock 8a. Thus, a support member is formed by the above-described balance cylinder 12A and the carrier beams 50, the support member capable of supporting the upper backup roll 4 in such a manner that the thus-supported upper backup roll 4 can be moved vertically. That is, the roll 4 may be vertically moved with the carrier beams 50 and the upper backup roll chocks 8, 8*a* when the balance cylinder 12A is operated.

Balance cylinders 52 each having a rod 52' which can be vertically extended, are incorporated in the lower ends 53 of the carrier beams 50. Side projections 15' are provided for a cylinder 15 of a hydraulic jack 17. The projections 15' are slidably fitted on the carrier beams 50. When the rods 52' are expanded by the operation of the balance cylinders 52, the upper end portions of the rods 52' engage with the projections 15', and the cylinder 15 is raised with these projections 15'. Thus, the hydraulic jack 17 is raised. When the rods 52' are retracted, the hydraulic jack 17 is lowered. It should be noted that the elements similar to the above-described elements (such as cylinders 52) relating to the hydraulic jack 17 are provided in connection with a hydraulic jack 17*a*.

The other structure of this third embodiment is substantially identical with that of the first embodiment. In FIGS. 8 and 9, the same components as those shown in FIGS. 1 to 6 are given the same reference numerals.

What is claimed is:

1. A rolling mill, comprising:

upper and lower work rolls arranged to be brought into contact with a material to be rolled;

upper backup roll means for supporting said upper work roll;

hydraulic jack means disposed above said upper backup roll means for adding a pressurizing load which has been adjusted according to a rolling load to said upper work roll via said upper backup roll means, said hydraulic jack means including a cylinder so disposed that a cylinder bore thereof faces downward and having an upper surface, and a ram slidably received in said cylinder bore and having a lower surface which is brought into contact with said upper backup roll means, wherein a top wall of said cylinder of said hydraulic jack means is relatively thick in a central portion thereof while it is relatively thin in a periphery of the same;

thrust metal means disposed on said upper surface of said cylinder and capable of being moved between a first position at which a rolling work is performed and a second position at which said rolls are exchanged, the second position being spaced apart from the first position in an axial direction of said upper backup roll means;

pressurizing screw means adapted to abut on an upper surface of said thrust metal means for restricting an upward movement of said thrust metal means to thereby determine a position of said upper work roll when said thrust metal means is at said first position; and actuator means mounted on said cylinder and operatively connected to said thrust metal means for moving said thrust metal means between said first position and said second position.

2. A rolling mill according to claim 1, wherein said thrust metal means includes: a housing; a seat accommodated in said housing and including a lower member having a spherical upper surface and an upper member having a spherical lower surface engaging with said spherical upper surface; and a thrust metal disposed on an upper surface of said seat.

3. A rolling mill according to claim 2, wherein said thrust metal means includes a load cell disposed below said seat in said housing.

4. A rolling mill, comprising:

upper and lower work arranged to be brought into contact with a material to be rolled;

upper backup roll means for supporting said upper work roll;

hydraulic jack means disposed above said upper backup rolls means for adding a pressurizing load which has been adjusted according to a rolling load to said upper work roll via said upper backup roll means, said hydraulic jack means including a cylinder so disposed that a cylinder bore thereof faces downward and having an upper surface, and a ram slidably received in said cylinder bore and having a lower surface which is brought into contact with said upper backup roll means;

thrust metal means disposed on said upper surface of said cylinder and capable of being moved between a first position at which a rolling work is performed and a second position at which said rolls are exchanged, the second position being spaced apart from the first position in an axial direction of said upper backup roll means;

pressurizing screw means adapted to abut on an upper surface of said thrust metal means for restricting an upward movement of said thrust metal means to thereby determine a position of said upper work roll when said thrust metal means is at said first position;

actuator means mounted on said cylinder and operatively connected to said thrust metal means for moving said thrust metal means between said first position and said second position; and lift means for lifting and lowering said hydraulic jack means; said lift means including a block secured to a housing of said rolling mill, and a cylinder incorporated in said block and having a rod which can be extended in vertical directions; said rod being adapted to engage with a projection projecting from said cylinder of said hydraulic jack means to lift and lower said projection, thereby lifting and lowering said hydraulic jack means together with said projection.

5. A rolling mill according to claim 4, wherein said thrust metal means includes: a housing; a seat accommodated in said housing and including a lower member having a spherical upper surface and an upper member having a spherical lower surface engaging with said spherical upper surface; and a thrust metal disposed on an upper surface of said seat.

6. A rolling mill according to claim 5, wherein said thrust metal means includes a load cell disposed below said seat in said housing.

7. A rolling mill, comprising:

upper and lower work arranged to be brought into contact with a material to be rolled;

upper backup roll means for supporting said upper work roll;

hydraulic jack means disposed above said upper backup roll means for adding a pressurizing load which has been adjusted according to a rolling load to said upper work roll via said upper backup roll means, said hydraulic jack means including a cylinder so disposed that a cylinder bore thereof faces downward and having an upper surface, and a ram slidably received in said cylinder bore and having a lower surface which is brought into contact with said upper backup roll means;

thrust metal means disposed on said upper surface of said cylinder and capable of being moved between a first position at which a rolling work is performed and a second position at which said rolls are exchanged, the second position being spaced apart from the first position in an axial direction of said upper backup roll means;

pressuring screw means adapted to abut on an upper surface of said thrust metal means for restricting an upward movement of said thrust metal means to thereby determine a position of said upper work roll when said thrust metal means is at said first position;

actuator means mounted on said cylinder and operatively connected to said thrust metal means for moving said thrust metal means between said first position and said second position; and support means for supporting said upper backup roll means from a position located above the latter roll means such that the supported upper backup roll means can be vertically moved, and lift means for lifting and lowering said hydraulic jack means; and support means including a balance cylinder arranged above said upper backup roll means and a carrier beam having an upper end connected to said balance cylinder and a lower end connected to said upper backup roll means; said lift means including a cylinder having a rod incorporated in a lower end portion of said carrier beam and capable of extending vertically; said rod being adapted to engage with a projection projecting from said cylinder of said hydraulic jack means to lift and lower said projection, thereby lifting and lowering said hydraulic jack means together with said projection.

8. A rolling mill according to claim 7, wherein said thrust metal means includes: a housing; a seat accommodated in said housing and including a lower member having a spherical upper surface and an upper member having a spherical lower surface engaging with said spherical upper surface; and a thrust metal disposed on an upper surface of said sheet.

9. A rolling mill according to claim 7, wherein said thrust metal means includes a load cell disposed below said seat in said housing.

10. A rolling mill, comprising:

upper and lower work rolls arranged to be brought into contact with a material to be rolled;

an upper backup roll for supporting said upper work roll;

hydraulic jack means disposed above said upper backup roll for adding a pressurizing load which has been adjusted according to a rolling load to said upper work roll via said upper backup roll, said hydraulic jack means including a cylinder so disposed that a cylinder bore thereof faces downward and having an upper surface, and a ram slidably disposed in said cylinder bore, wherein a top wall of said cylinder of said hydraulic jack means is relatively thick in a central portion thereof while it is relatively thin in a periphery of the same;

thrust metal means disposed on said upper surface of said cylinder;

pressurizing screw means adapted to abut on an upper surface of said thrust metal means for restriction an upward movement of said thrust metal means, thereby determination a position of said upper work roll; and a control unit mounted on said cylinder for controlling a quantity of pressurized oil in a space defined between said cylinder and said ram in accordance with a rolling load.

11. A rolling mill according to claim 10, wherein said thrust metal means includes: a housing, a seat accommodated in said housing and including a lower member having a spherical upper surface and an upper member having a spherical lower surface engaging with said spherical upper surface; and a thrust metal disposed on an upper surface of said seat.

12. A rolling mill according to claim 11, wherein said thrust metal means includes a load cell disposed below said seat in said housing.

* * * * *